United States Patent [19]

Nadin

[11] Patent Number: 5,057,033

[45] Date of Patent: Oct. 15, 1991

[54] BRANCH CONDUCTOR CONNECTING DEVICE

[75] Inventor: Léonard Nadin, L'Union, France

[73] Assignee: Societe anonyme dite : Labinal, Montigny Le Bretonneux, France

[21] Appl. No.: 558,490

[22] Filed: Jul. 27, 1990

[30] Foreign Application Priority Data

Aug. 7, 1989 [FR] France ..... 89 10603

[51] Int. Cl.[5] ..... H01R 4/24

[52] U.S. Cl. ..... 439/397

[58] Field of Search ..... 439/389–425

[56] References Cited

U.S. PATENT DOCUMENTS 4,037,905 7/1977 Lucas ..... 439/395

4,348,072 9/1982 Gudaitis ..... 439/395

4,472,596 9/1984 Brown et al. ..... 439/407

*Primary Examiner*—Joseph H. McGlynn

*Attorney, Agent, or Firm*—Sandler, Greenblum & Bernstein

[57] ABSTRACT

Device for connecting a branch connector to an insulated main conductor has a body made from a strip of metal that is a good electrical conductor. This body is cut and folded to a U-shape cross-section comprising a web, two flanges and lugs for connecting the branch conductors. The U-shape cross-section part includes two slots adapted to be forced-fitted to the insulated main conductor to cut the insulation and make the electrical connection.

15 Claims, 8 Drawing Sheets

BRANCH CONDUCTOR CONNECTING DEVICE

BACKGROUND OF THE INVENTION

1. Field of the invention

The present invention concerns a device for connecting a branch conductor to an insulated main conductor.

The invention is more particularly, but not exclusively, concerned with the manufacture of wiring harnesses for the supply of electrical power to electrical equipment on vehicles.

2. Description of the prior art

The increased quantity of electrical equipment on electric vehicles increases the size of the wiring harnesses.

Multiple conductor ends must be at the same potential at the same time, which makes it necessary to splice these conductors, with the result that the harness is bulky and impossible to manufacture on automatic machines. Consequently, it is necessary to consider manufacturing these harnesses manually on assembly boards, which is also difficult.

One object of the present invention is to provide a simple device which makes automatic assembly possible and with which splices can be dispensed with.

SUMMARY OF THE INVENTION

The invention consists in a device for connecting a branch conductor to an insulated main conductor, comprising a body made from a strip of metal that is a good electrical conductor cut out and bent to a U-shape cross-section comprising a web and two flanges each incorporating a slot opening onto its free edge and adapted to be force-fitted to the insulated main conductor, at least one of the flanges having a tang at each end, and the tangs being bent to extend outwardly of said U-shape perpendicularly to said flange.

By virtue of this arrangement, it is sufficient to place the device on the main conductor, the insulation being cut by the edges of the slots and, the device being electrically connected in this way, it is sufficient to insert over the lugs female contact members fitted to appropriate branch conductors.

In a preferred embodiment of the invention each end of each flange incorporates a lug extending perpendicularly to it and bent so as to extend outwardly of the U-shape parallel to the web.

In one embodiment of the invention each flange is cut near each end perpendicularly to the web to form a lug which is bent to extend outwardly of the U-shape parallel to the web.

The device preferably comprises an insulative housing adapted to receive the body and the main conductor.

In one specific embodiment of the invention the housing comprises two identical housing members designed to fit together the opposite way round and the opposite way up with respect to each other, each member being generally rectangular in shape and comprising a central recess adapted to receive the body, an axial cradle for the main conductor, near one end, along two opposite sides, lugs terminated by hooks, near the other end, along the two opposite sides, plates in corresponding relationship to the lugs and incorporating holes, there being provided on either side of the cradle corridors for the passage of electrical contact members to be connected to the device, the housing members comprising spring bars projecting into the corridors and carrying pegs adapted to cooperate with the contact members.

The housing members preferably comprise means for locking the spring bars.

The housing members preferably comprise a cover hinged at one end and provided with flanges adapted to cover the notches into which the spring bars extend, means being provided for locking the cover in a closed position.

In one embodiment of the invention the housing members comprise a cover hinged at one end and incorporating means for locking it against the outside surface of the member, the spring bars being cut into the corridors and incorporating pegs projecting into the latter.

Finally, in a preferred embodiment, the cover has near its free edge a first step adapted to cooperate with a shoulder on the housing member, the positions of the step and shoulder being such that the cover occupies a ready position in which the spring bars can move to enable insertion of the female contact members, a second step and a second shoulder being provided for locking said cover in a fully closed position to immobilize the spring bars and therefore to lock the female contact members in position.

The invention will now be described in more detail with reference to specific embodiments described by way of example only and shown in the appended drawings.

DETAILED DESCRIPTION OF THE INVENTION

Figure 1:
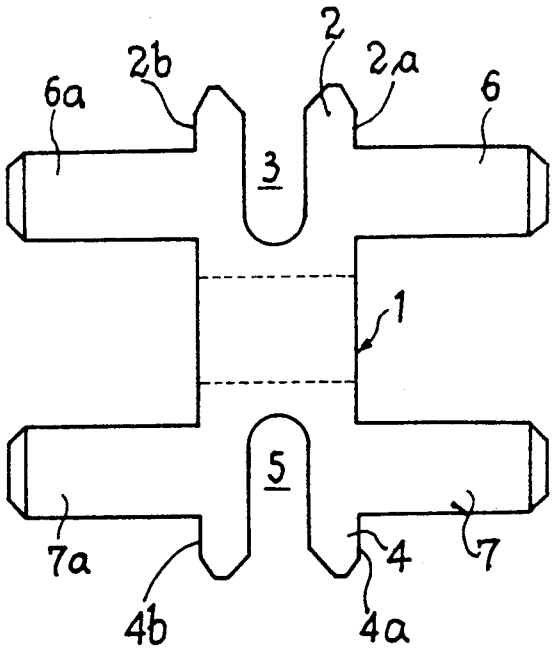
FIG. 1 is a plan view of a device in accordance with the invention showing how it is cut out from a flat sheetmetal blank.
Figure 2:
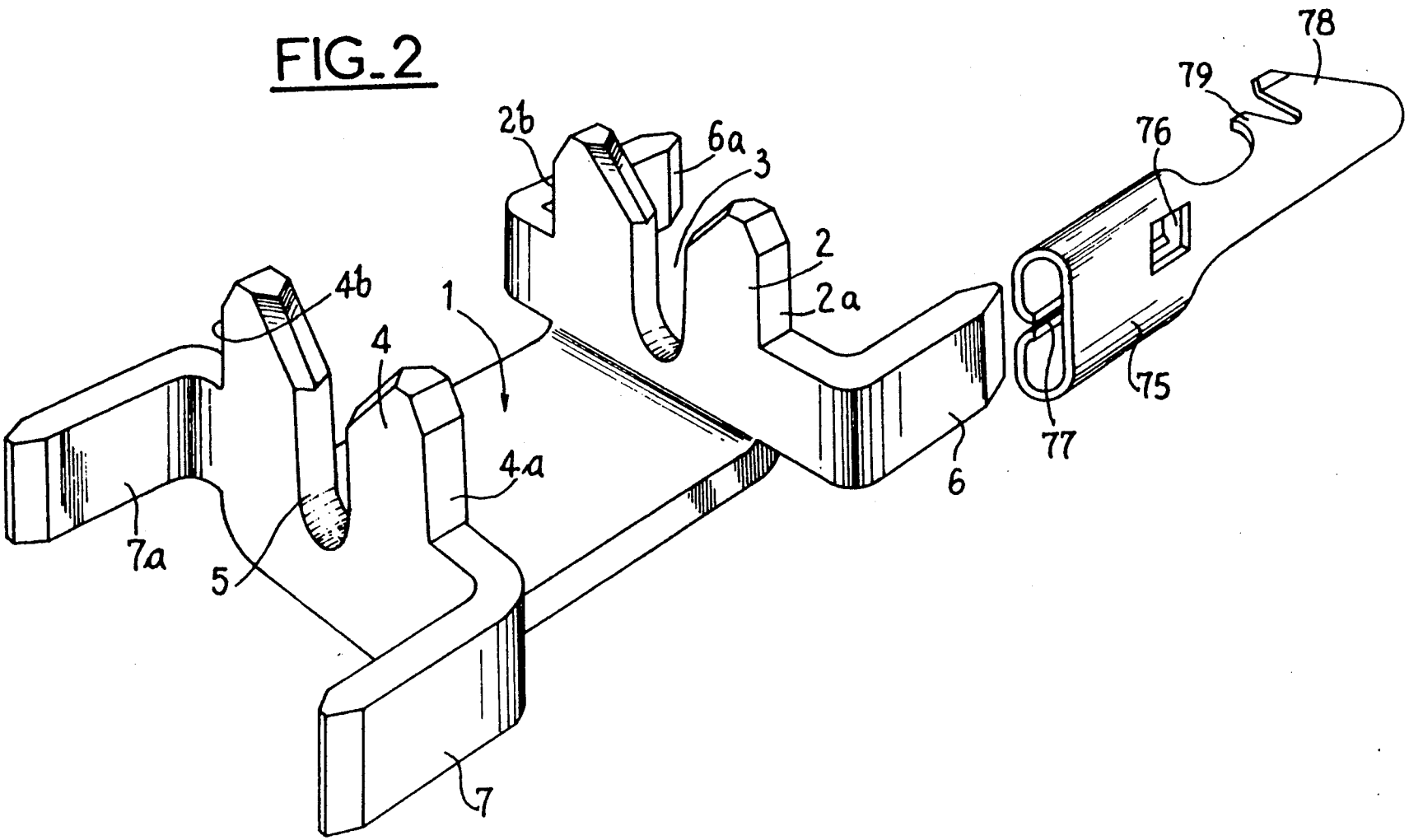
FIG. 2 shows the finished device in perspective.

FIGS. 1 and 2 show the body part of a connecting device, made by cutting and bending a strip of metal that is a good electrical conductor. It is generally U-shaped with a web 1 and two flanges 2 and 4.

The flange 2 features a centrally located slot 3 which extends to a point near the web 1 and which has an outwardly flared portion opening onto its free edge.

The flange 4 is cut out in the same way as the flange 2 and incorporates a slot 5.

The flange 2 comprises at its end 2*a* a lug 6 bent to extend substantially parallel to the web 1 and outwardly of the U-shape.

The end 2*b* of the lug 2 incorporates a lug 6*a*parallel to the lug 6.

The flange 4 has at its ends 4*a* and 4*b* respective lugs 7 and 7*a*.

A device of this kind is used to make branch connections to grounding wires, in particular, an insulated main grounding cable being force-fitted into the slots 3 and 5 in such a way that the insulation is cut by the edges of the slots 3 and 5. Female contact members attached to branch conductors are then fitted over the lugs 6, 7, 6*a*, 7*a*.

Figure 4:
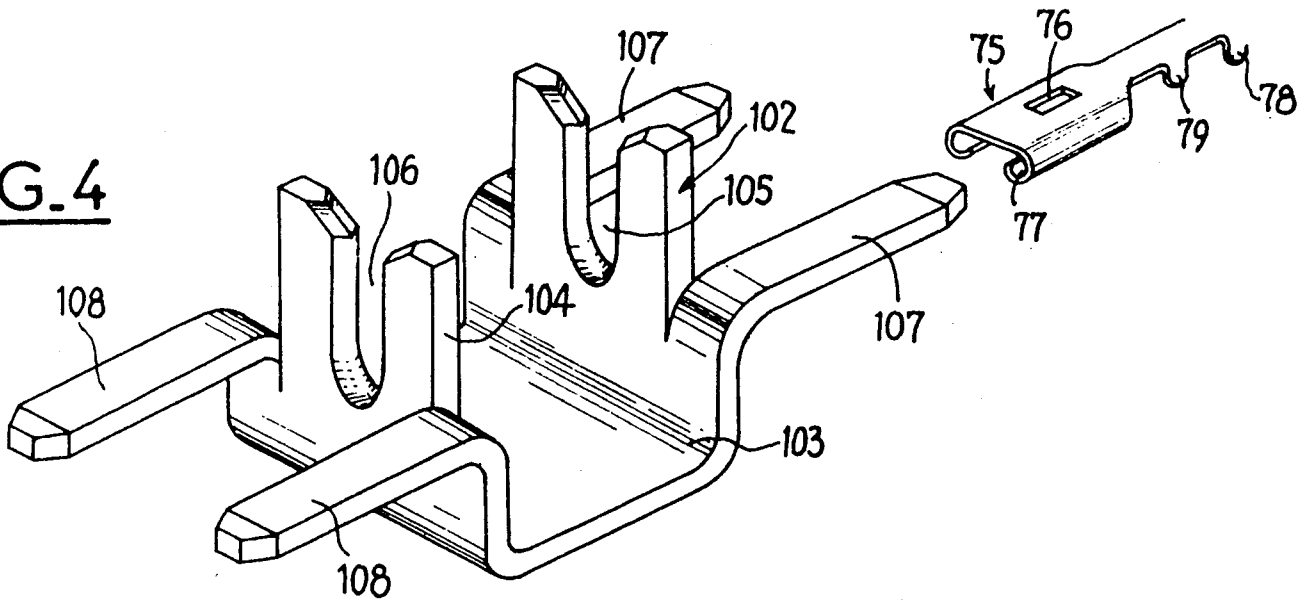
FIG. 4 is a perspective view of the device produced from the blank shown in FIG. 3.
Figure 3:
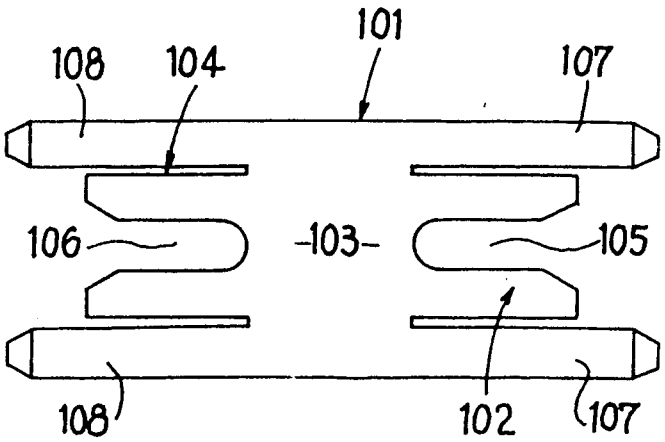
FIG. 3 is a plan view of another embodiment of the device showing how it is cut out from a flat sheetmetal blank.

FIGS. 3 and 4 show an alternative embodiment of the body part of the device which is made by cutting and bending a strip 101 of metal to a U-shape having two flanges 102 and 104 and a web 103.

The flanges 102 and 104 incorporate respective centrally located slots 105 and 106 which have outwardly flared portions opening onto the free edge of the respective flange.

The flange 102 comprises lugs 107 at each end which are bent to extend substantially parallel to the web 103 and outwardly of the device.

Two lugs 108 are provided at respective ends of the flange 104, coplanar with the lugs 107.

As compared with the FIG. 1 and 2 embodiment, this arrangement has the advantage of being more economic, less of the metal strip from which the device is cut out being wasted.

FIGS. 5 through 12 show a housing made up of two identical housing members disposed the opposite way up and the opposite way round relative to each other. The housing is adapted to receive the body part of the device from FIGS. 1 and 2.

Each insulative molded plastics material housing member 35 has in its central part a recess 36 adapted to receive the body part of the device from FIGS. 1 and 2.

From one end 40 and extending along an edge 45 the housing member 35 comprises two spring lugs 37 and 37*a*terminating in outwardly facing hooks. On the same side, but at the opposite end, it incorporates two plates 38 and 38*a* with holes 41 matching the hooks.

The other longitudinal edge 46 of the housing member 35 also incorporates lugs 37 and 37*a* and plates 38 and 38*a* with holes 41.

The housing member 35 includes to one side of the recess 36 an axial cradle 43 which is circular arc-shaped in cross-section with a second cradle 44 having a matching cross-section on the other side of the recess 36.

From the end 40 and extending along the edges 45 and 46, the housing member 35 has rims 50. At the end opposite the end 40, the edges 45 and 46 include guide tenons 49, 49*a* and 49*b*, so that when two housing members are offered up to each other with one the opposite way up and the opposite way round, the tenons 49, 49*a* and 49*b*are inserted between the rims 50.

There are two corridors 52 and 52*a* between the tenons 49 and the cradle 44. There are two like corridors 53 and 53*a* between the cradle 43 and the rims 50.

Along each edge 45 and 46 between the plates 38 and 38*a* the housing member 35 incorporates notches 60 and 60*a*which respectively open into the corridors 52 and 52*a*.

Each of the plates 38*a* adjacent the end of the housing member 35 opposite its end 40 includes a spring bar 56 which extends into the corresponding notch 60, 60*a*. The spring bars are provided with a peg 57 on the side facing towards the respective corridors 52, 52*a*.

The end of the housing member 35 opposite its end 40 is joined by a flexible strip 64 to a cover 65 which has two side flanges 66 and, near the free edge of each of the side flanges, a step 67, and a second step 68 being provided in the vicinity of each flange 66, offset heightwise relative to the step 67.

The tenons 49*a* incorporate a shoulder 71 adapted to lock the cover 65 by cooperating with the step 68. On their corresponding edge the plates 38 have a shoulder 70 adapted to cooperate with the step 67 in a standby position. In this position the free edges of the flanges 66 lie outside the spring bars 56, so that they can move freely.

Figure 5:
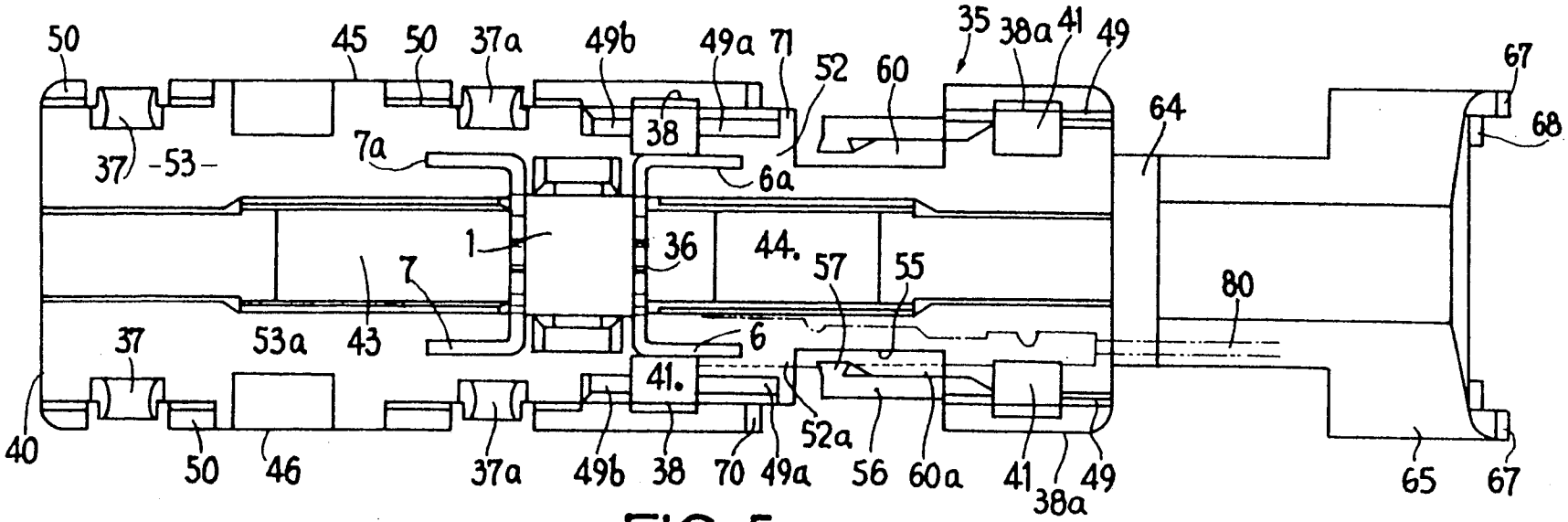
FIG. 5 is a plan view of a housing member.
Figure 6:
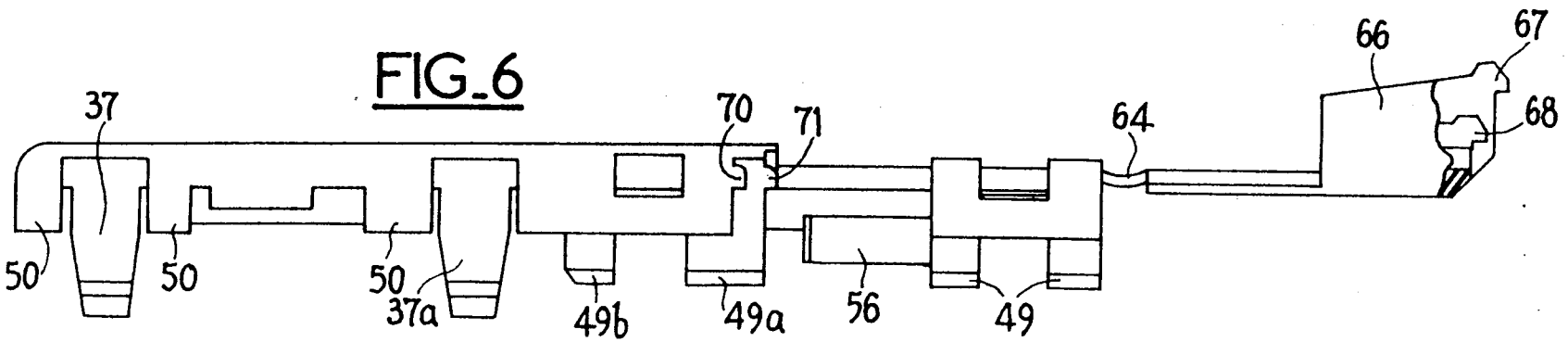
FIG. 6 is an elevation view of the housing member from FIG. 5.
Figure 7:
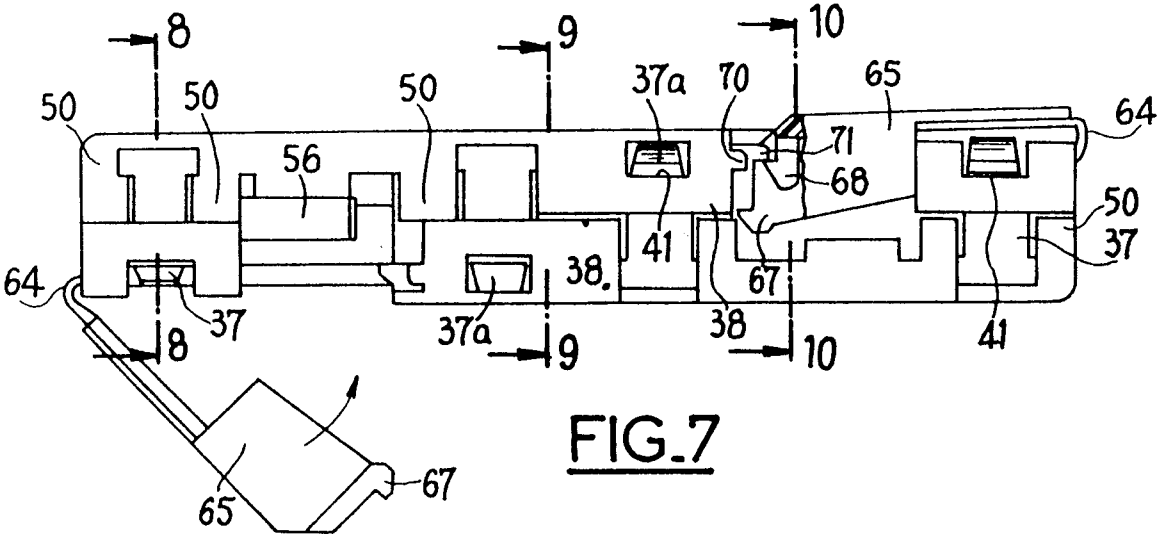
FIG. 7 is an elevation view of two assembled housing members.
Figure 10:
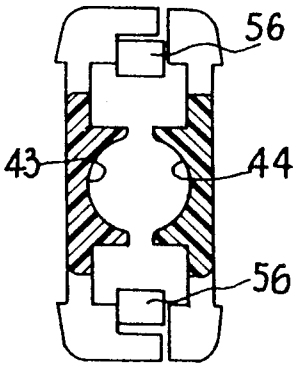
FIG. 10 is a view in cross-section on the lines 10—10 in FIG. 7.
Figure 9:
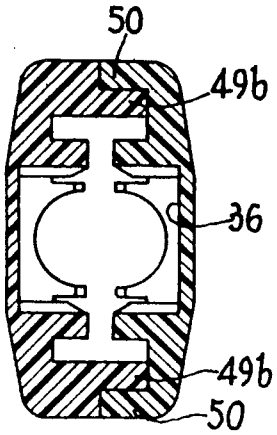
FIG. 9 is a view in cross-section on the lines 9—9 in FIG. 7.
Figure 8:
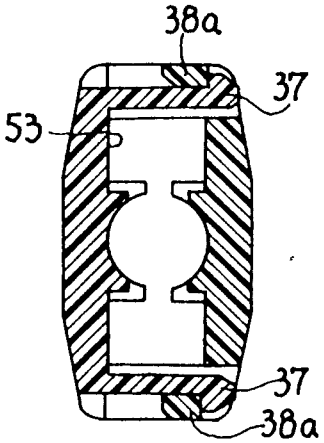
FIG. 8 is a view in cross-section on the lines 8—8 in FIG. 7.
Figure 11:
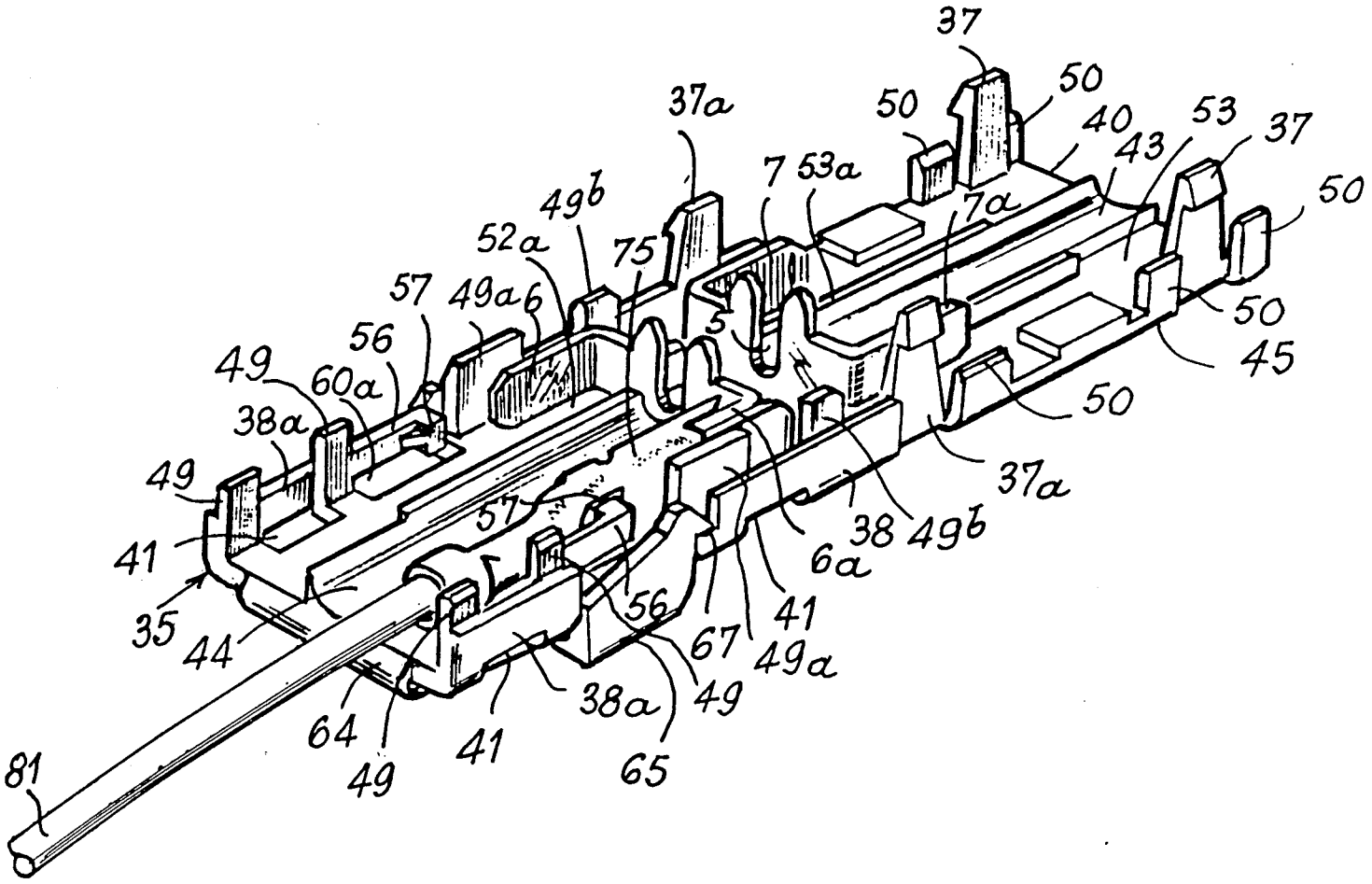
FIG. 11 is a perspective view showing a housing member.
Figure 12:
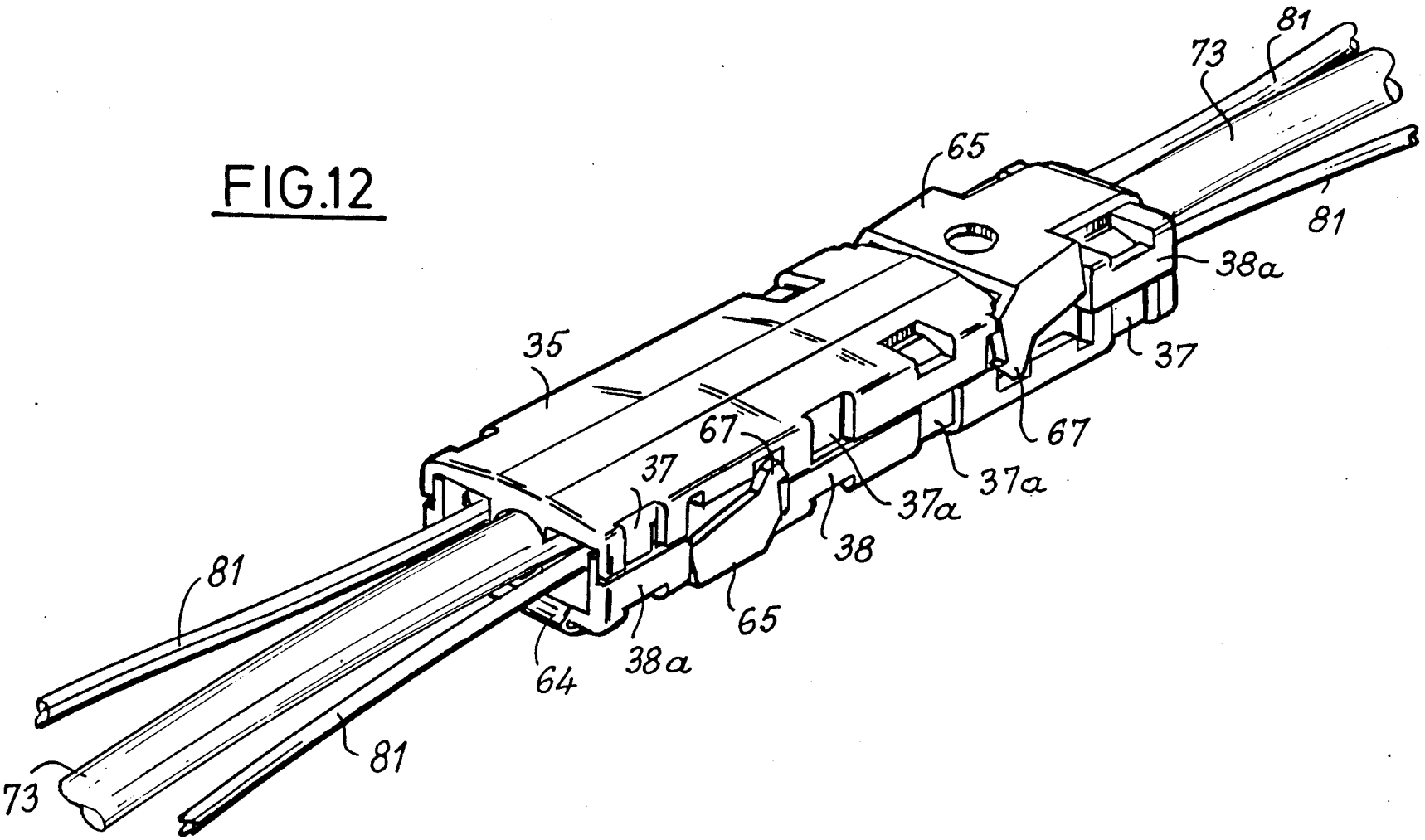
FIG. 12 is a perspective view showing two assembled housing members.

As seen in FIGS. 5 and 11, the body part of the device is fitted into the recess 36 in such a way that the tangs 6*a* and 7*a* extend into the corridors 52 and 53 and the tangs 7 and 6 extend into the corridors 53*a* and 52*a*.

The housing member accommodating the body part of the device can be fitted to a insulated main grounding conductor 73 which is force-fitted into the slots 3 and 5 in such a way that the insulation is cut by the edges of the slots so that contact is established between said conductor and the body part of the device, the conductor 73 resting in the cradles 43 and 44 and the cover 65 being in the standby position, the steps 66 cooperating with the shoulders 70.

A second identical housing member is mounted on the first member the other way round and the other way up so that the hooks on the lugs 37 and 37*a* on one lock onto the other by cooperating with the holes 41 in the plates 38, 38*a*. This assembly is facilitated by the tenons 49, 49*a* and 49*b* which guide the two members relative to each other until they are assembled together.

At each end of the two assembled housing members the corridors 53, 53*a* and 52, 52*a* form channels into which female electrical contact members 75 can be inserted, having at one end a receptacle 77 adapted to be force-fitted over the lugs 6 and 7 and at the other end crimping lugs 78 and 79 for securing a conductor 81, said member 75 having in it a hole 76 larger than the pegs 57.

When the members 75 are pushed on they engage with the pegs 57 to push back resiliently the spring bars 56, which return to their original position when the pegs 57 enter the holes 56. The spring bars 56 can then be locked in place by closing the cover the 65 completely, in which position the steps 68 cooperate with the shoulders 71.

Figure 13:
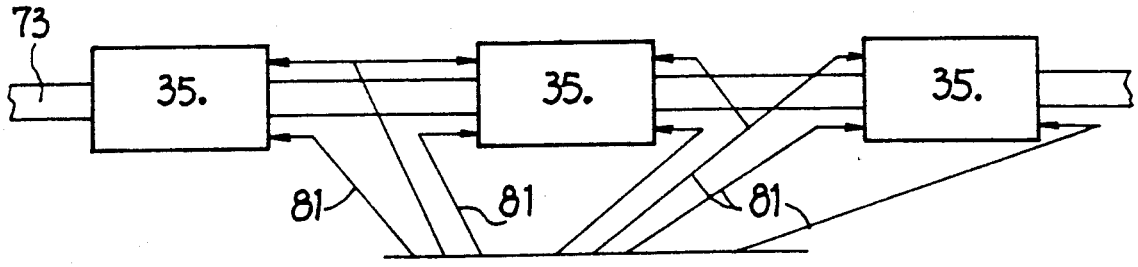
FIG. 13 shows the use of one embodiment of the device in accordance with the invention.

Referring to FIG. 13, the main grounding wire 73 can be fitted with multiple combinations of housings and devices for connecting secondary cables 81, which greatly simplifies wiring.

Figure 14:
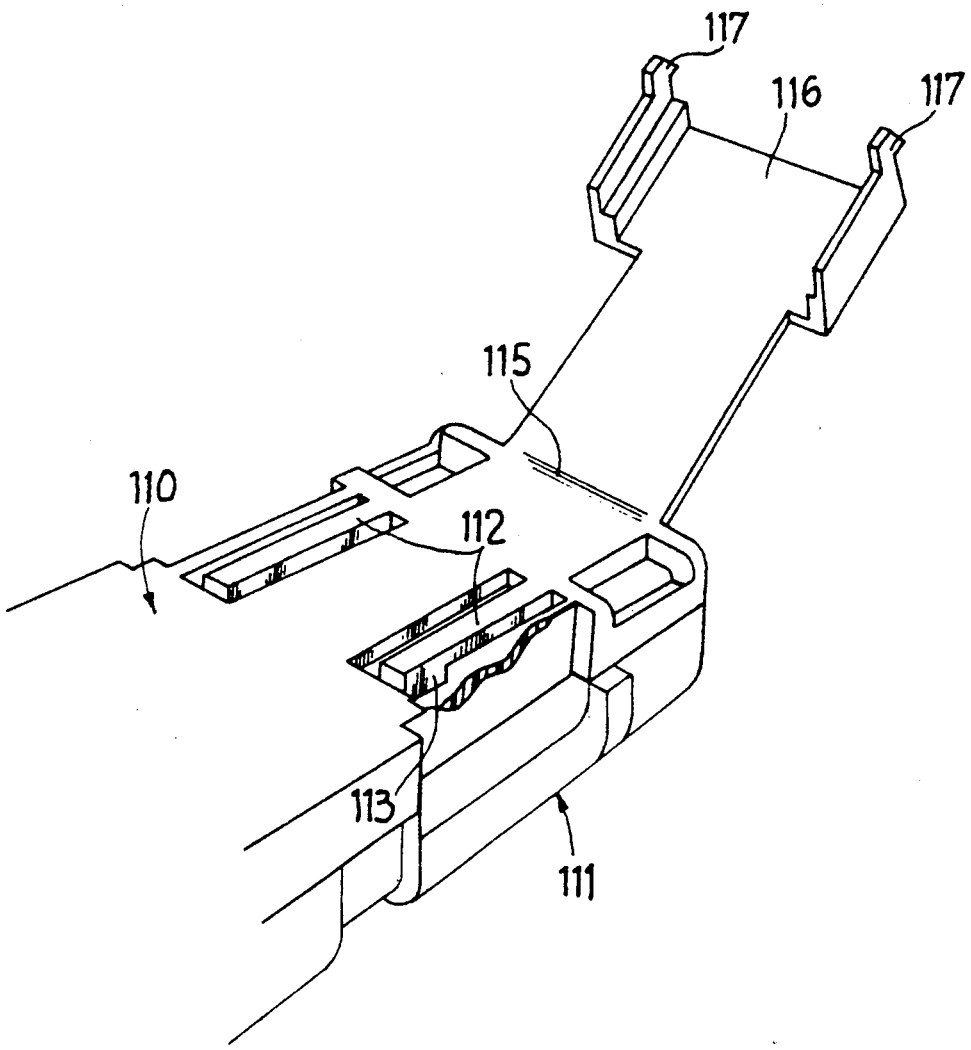
FIG. 14 is a perspective view showing an alternative embodiment of the housing member usable with the device from FIGS. 5 and 6.

FIG. 14 is a perspective view of an alternative embodiment of the housing members adapted to receive the body part of the device from FIGS. 3 and 4.

As in the previous figures the housing is formed by two identical parts offered up to each other the opposite way round and the opposite way up.

These two members 110 and 111 are made the same way as the member 35 but the female electrical contact members 75 adapted to fit onto the tangs 107 and 108 are offered up flat rather than on edge, so that the surface of the member 75 incorporating the hole 76 bears against the back 52, 52*a* and 53, 53*a*. Two spring bars 112 are cut into the corridors and feature pegs 113 for locking the female contact members, these bars being near a flexible strip 115 to which a cover 116 is hinged.

The cover 116 is made the same way as the cover 65 and its lateral flanges 117 incorporate steps to cooperate with corresponding shoulders and which can occupy a ready position in which the bars 112 can flex elastically and a locked position in which they are immobilized by the back of the cover.

Of course, the invention is not limited to the embodiments that have just been described and shown. Numerous modifications of detail may be made to these without departing from the scope of the invention.

There is claimed:

1. Device for connecting a branch conductor to an insulated main conductor, comprising a body composed of a strip of metal that is a good electrical conductor cut out and bent to a U-shape cross-section, said body having a U-shaped cross-section including an inner web portion and two flange portions, each flange portion extending substantially upwardly to a free edge from opposite sides of said inner web portion and including a slot opening onto the free edge which is capable of being force-fitted to an insulated main conductor, and at least one of said two flange portions having at least one tang, with said at least one tang being bent to extend substantially perpendicular to said at least one flange portion and outwardly of said body.

2. The device according to claim 1, wherein each of said two flange portions comprises at least one tang extending substantially perpendicular to the flange portion, outwardly of said body, and substantially parallel to said inner web portion.

3. The device according to claim 1, wherein, prior to bending, said strip of metal includes two flange portions having at least one tang extending substantially parallel to each flange portion, and each said at least one tang being bent to extend substantially perpendicularly to the flange portion, outwardly of said body, and substantially parallel to said inner web portion.

4. The device according to cl aim 1, wherein, prior to bending, said strip of metal includes two flange portions having at least one tang extending substantially perpendicular to each flange portion, and each said at least one tang being bent to extend substantially perpendicularly to the flange portion, outwardly of said body, and substantially parallel to said inner web portion.

5. The device according to claim 1, further comprising an insulative housing capable of receiving said body and the insulated main conductor.

6. The device according to claim 5, wherein said housing comprises:

two identical housing members constructed to fit together with one an opposite way round and an opposite way up with respect to the other, each housing member being generally rectangularly shaped and comprising:

a central recess capable of receiving said body;

an axial cradle for the insulated main conductor;

near one end, along two opposite sides, lugs terminated by hooks;

near the other end, along said two opposite sides, plates in corresponding relationship to said lugs and incorporating holes;

at least one corridor on at least one side of said axial cradle for passage of electrical contact members; and at least one spring bar projecting into said at least one corridor, said at least one spring bar including a peg capable of cooperating with an electrical contact member.

7. The device according to claim 6, wherein said housing members comprise means for immobilizing said at least one spring bar.

8. The device according to claim 7, wherein said housing members comprise a cover hinged at one end and including means for locking said cover against an external surface of the housing member, and said at least one spring bar being cut into said at least one corridor and said peg projects therein.

9. The device according to claim 7, wherein said housing members comprise a cover hinged at one end and including flanges adapted to cover notches into which said spring bars extend, and means for locking said cover in a closed position.

10. The device according to claim 9, wherein said cover extends to a free end and includes near said free end a first step adapted to cooperate with a first shoulder provided on the housing member, said first step and first shoulder being located to permit said cover to occupy a ready position in which said at least one spring bar can move, and a second step and a second shoulder for locking said cover in a fully closed position.

11. A housing comprising:

two identical housing members constructed to fit together with one an opposite way round and an opposite way up with respect to the other, each housing member being generally rectangularly shaped and comprising:

a central recess capable of receiving a body composed of a strip of metal that is a good electrical conductor cut out and bent to a U-shape cross-section, the body having a U-shaped cross-section including an inner web portion and two flange portions, each flange portion extending substantially upwardly to a free edge from opposite sides of the inner web portion and including a slot opening into the free edge which is capable of being force-fitted to an insulated main conductor, and at least one of the two flange portions having at least one tang, with the at least one tang being bent to extend substantially perpendicular to the at least one flange portion and outwardly of the body;

an axial cradle for the insulated main conductor;

near one end, along two opposite sides, lugs terminated by hooks;

near the other end, along said two opposite sides, plates in corresponding relationship to said lugs and incorporating holes;

at least one corridor on at least one side of said axial cradle for passage of electrical contact members; and at least one spring bar projecting into said at least one corridor, said at least one spring bar including a peg capable of cooperating with an electrical contact member.

12. The device according to claim 11, wherein said housing members comprise means for immobilizing said at least one spring bar.

13. The device according to claim 11, wherein said housing members comprise a cover hinged at one end and including means for locking said cover against an external surface of the housing member, and said at least one spring bar being cut into said at least one corridor and said peg projects therein.

14. The device according to claim 11, wherein said housing members comprise a cover hinged at one end and including flanges adapted to cover notches into which said spring bars extend, and means for locking said cover in a closed position.

15. The device according to claim 14, wherein said cover extends to a free end and includes near said free end a first step adapted to cooperate with a first shoulder provided on the housing member, said first step and first shoulder being located to permit said cover to occupy a ready position in which said at least one spring bar can move, and a second step and a second shoulder for locking said cover in a fully closed position.

* * * * *